US007658187B2

(12) United States Patent
Budiac et al.

(10) Patent No.: US 7,658,187 B2
(45) Date of Patent: Feb. 9, 2010

(54) ADJUSTABLE STONE CUTTING GUIDE SYSTEM

(76) Inventors: John Budiac, 1097 Fairfield Ct., West Bend, WI (US) 53090; Gregory J. Peplinski, 1434 Park Knoll Dr., Hartford, WI (US) 53027

( * ) Notice: Subject to any disclaimer, the term of this patent is extended or adjusted under 35 U.S.C. 154(b) by 275 days.

(21) Appl. No.: 11/623,732

(22) Filed: Jan. 16, 2007

(65) Prior Publication Data

US 2008/0168879 A1 Jul. 17, 2008

(51) Int. Cl.
*B28D 1/04* (2006.01)

(52) U.S. Cl. ..... 125/13.01; 451/439

(58) Field of Classification Search ..... 125/13.01, 125/14; 451/439
See application file for complete search history.

(56) References Cited

U.S. PATENT DOCUMENTS 2,326,264 A * 8/1943 Stetler ..... 451/354
4,557,245 A 12/1985 Bieri
4,832,412 A * 5/1989 Bertrand ..... 299/39.3
4,919,384 A 4/1990 Grimberg
4,998,775 A 3/1991 Hollifield
5,206,999 A 5/1993 Stone
6,293,269 B1 9/2001 Selb et al.
6,757,981 B2 7/2004 Hampton
6,874,493 B2 4/2005 Glenn
6,990,972 B2 1/2006 Markley

* cited by examiner

*Primary Examiner*—Robert Rose
(74) *Attorney, Agent, or Firm*—Ziolkowski Patent Solutions Group, SC

(57) ABSTRACT

A material cutting system for cutting predetermined widths of stone. The system includes a fixed frame that is solidly affixed to the stone in the ground. A set of tracks rest on the ground and are adjustably spaced apart to receive the wheels of a stone cutting machine to control the movement of the cutting machine along a straight line to make a cutting pass. A track adjusting system moves the tracks a predetermined distance to allow a subsequent pass to cut the stone. The track adjustment system includes a motive device, such as a winch, affixed to the fixed frame having cables that extend to the tracks such that operation of the winch moves the track laterally toward the fixed frame. The amount of movement is accurately controlled by a spacing member having a predetermined length that provides a gauge to control the lateral movement of the tracks.

15 Claims, 4 Drawing Sheets

ADJUSTABLE STONE CUTTING GUIDE SYSTEM

FIELD OF THE INVENTION

The present invention relates to a system for cutting materials and, more particularly, to a system for cutting stone in passes spaced apart a predetermined distance.

BACKGROUND OF THE INVENTION

Stone cutting is normally initially done at the site of the stone in a quarry and generally utilizes a large wheeled cutting machine that is powered by a motor that both operates the cutting blade as well as the propulsion system that moves the cutting machine in a straight line across the stone in carrying out the cutting operation. In general, the cutting operation may require a plurality of cuts along the straight line of ever deepening cuts in order to cut the stone to the desired depth.

To provide dimensionally accurate stones, therefore, it is necessary to cut the stone by moving the cutting machine into different locations along a lateral direction for the straight cuts, that is, after each straight cut to the desired depth, the cutting machine is moved laterally a specific distance whereupon the cutting machine is again propelled in a straight line to make a subsequent cut parallel to and at a known distance apart from the prior cut.

As such, after the cutting machine has made a plurality of passes along one straight line, that cutting machine then needs to be moved laterally in order to make a second cut and that lateral movement needs to be carried out accurately in order to make the eventual dimension of the stone within acceptable tolerances.

One of the problems, however, in making the multiple passes or cuts is that the terrain generally is uneven and it is difficult to align the subsequent cuts with precision to be the predetermined distance apart from the initial cut, that is, it is difficult to judge the amount of lateral movement that is needed to properly set up the cutting machine for a further cut a predetermined distance away from the immediate preceding cut.

Accordingly, it would, therefore, be desirable to have system that would allow the cutting of dimensionally accurate stone that is robust and can withstand the conditions at a quarry and yet provide an accurate system to make progressive cuts in the stone at predetermined lateral distances between each cut.

BRIEF SUMMARY OF THE INVENTION

Therefore, in accordance with the present invention, there is a material cutting apparatus and track adjusting system that provides a robust yet accurate system to laterally move the tracks used to guide a cutting machine across a layer of stone to make a cut in that stone.

With the present invention, the track adjustment system moves the tracks laterally a predetermined distance to allow the cutting machine to make a new cut and includes a fixed frame that is solidly affixed to the ground by being anchored to the layer of stone. A pair of horizontal members are slidably affixed to the fixed frame and extend outwardly therefrom with distal ends affixed to the tracks.

There are motive devices that are provided and which are affixed to the fixed frame and to the tracks and, in an exemplary embodiment, the motive devices are winches that are affixed to the fixed frame with a cable extending therefrom having free ends affixed to the tracks. As such, by operating the winches, the tracks can be moved laterally toward the fixed frame so that the cutting machine can be relocated to a new location a predetermined distance from the prior location.

The predetermined distance or total lateral movement of the tracks is accurately controlled by the use of spacing members that are removably affixed, in end to end relationship, to the horizontal members. One of the spacing members is in abutting contact with the fixed frame and, in moving the tracks the predetermined distance, the spacing member or members contacting the fixed frame is removed whereupon the winches are operated to draw the tracks laterally closer to the fixed frame up to the point the next succeeding spacing member comes into contact with the fixed frame, thereby blocking the further movement of the tracks. The total distance of movement of the tracks is thus gauged accurately by the length of the removed spacing member or members.

There is also a locking device that locks the horizontal members to the fixed frame and the locking member is designed to be disengaged to allow the movement of the horizontal member and tracks with respect to the fixed frame. Once the tracks have been relocated to the new location at the predetermined distance gauged by a spacing member, the locking device can be re-engaged to lock the horizontal members firmly to the fixed frame to allow the cutting machine to ride in the tracks in carrying out a pass cutting the stone.

As a further feature, the spacing between the individual tracks is adjustable in order to accommodate different sized cutting machines, that is, to space the tracks apart in accordance with the spacing between the wheels of differing cutting machines.

Therefore, according to one aspect of the present invention, a material cutting apparatus for cutting predetermined widths of a material includes at least one track and a cutting machine adapted to move along the at least one track. The cutting machine includes a cutting blade adapted to cut material as the cutting machine progresses along the at least one track. The apparatus also includes a track adjustment system adapted to move the at least one track a predetermined distance in a generally lateral direction to a new location to cut the material at a predetermined width.

In accordance with another aspect of the present invention, a track adjustment system for adjusting the location of a material cutting machine having wheels includes a pair of parallel, spaced apart tracks adapted to receive the wheels of a material cutting machine. The track adjustment system is adapted to move the tracks a predetermined distance in a generally lateral direction to a new location. The track adjustment system includes a fixed frame and at least one horizontal member slidingly affixed to the fixed frame, the at least one horizontal member having a distal end affixed to the spaced apart tracks, and a motive device adapted to move the tracks from a first location to a second location a predetermined distance from the first location.

In accordance with yet another aspect of the present invention, a method of relocating tracks designed to support a material cutting machine having wheels includes positioning a frame in a fixed location on the ground, providing a pair of generally parallel tracks spaced apart to support the wheels of the material cutting machine at a first location, and moving a material cutting machine along the tracks to make a cut in the material. The method also includes providing at least one horizontal member slidably affixed to the frame and having a distal end affixed to the tracks, providing a motive system affixed to the frame and to the tracks adapted to move the tracks relative to the frame, and moving the tracks with respect to the frame to relocate the tracks from the first location to a second location a predetermined distance from the first location.

These and other features and advantages of the present invention will become more readily apparent during the following detailed description taken in conjunction with the drawings herein.

DETAILED DESCRIPTION OF THE INVENTION

Figure 1:
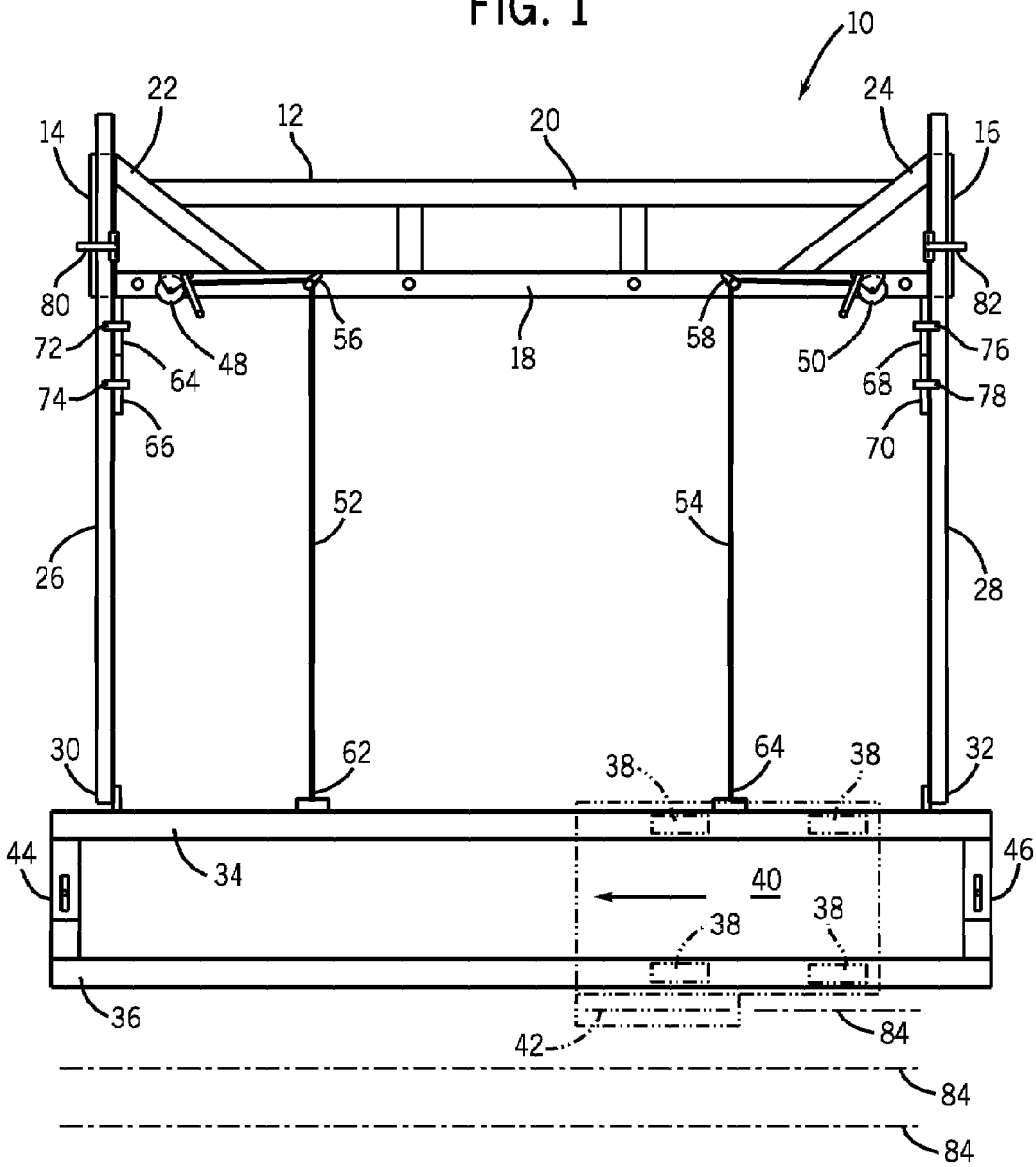
FIG. 1 is a top plan view of the material cutting apparatus constructed in accordance with the present invention illustrating the apparatus in one position.

Referring now to FIG. 1, there is shown a top, plan view of the material cutting apparatus 10 of the present invention. As will be hereinafter described, the material will be described in the exemplary embodiment as a dimensional stone, however it will be seen that other materials could be cut utilizing the system of the present invention.

In any event, as can be seen, there is a fixed frame 12 that is adapted to be solidly affixed to the ground surface, and, as, explained, the frame 12 can be affixed to the ground by means such as by bolting, to the stone itself on which the material cutting apparatus 10 is positioned and which is being cut. The frame 12 may take a variety of configurations but in general is constructed of steel members, such as angle irons and includes side frame members 14, 16 that are generally parallel to each other and further includes cross frame members 18, 20 and angle frame members 22, 24.

A pair of horizontal members 26, 28 extend outwardly from the fixed frame 12 and are slidingly affixed thereto as will be later seen. The horizontal members 26, 28 have distal ends 30, 32, respectively, that are affixed to one or both of a pair of tracks 34, 36. As shown in the exemplary embodiment, there are two tracks 34, 36 used with the present invention, however, there may be only one track or there may be more than two tracks consistent with the purpose and intent of the present invention.

With the two track embodiment, as shown in FIG. 1, the tracks 34, 36 are generally parallel to each other and are spaced apart a predetermined distance. That predetermined distance is determined so as to receive wheels 38 of a cutting machine 40 such that the wheels 38 of the cutting machine 40 are received in and are guided along a straight line by the tracks 34, 36 in making cutting passes in the stone material.

The cutting machine 40 is, itself, a conventional piece of apparatus and which is powered by a motor that both powers a cutting blade 42 as well as powers the movement of the cutting machine 40 along the tracks 34, 36.

As can also be seen, there are cross members 44, 46 that span the distance between the tracks 34, 36 in order to assure the parallel orientation of the respective tracks 34, 36 as well as to provide adjustability of the distance between the tracks 34, 36 in order to space the tracks 34, 36 for differing sized cutting machines 40. A means of carrying out that space adjustability will be later explained more fully.

There can also be seen in FIG. 1, motive devices that are used to move the tracks 34, 36 toward the fixed frame 12 when it is desired to make a new cut in the stone. The exemplary motive devices are manually operated winches 48, 50 that are affixed to the frame 12 and which have cables 52, 54 that pass through pulleys 56, 58 and with free ends 60, 62 that are affixed to the track 34. As can therefore be understood, by manually cranking the winches 48, 50 to draw the cables 52, 54 inwardly, the tracks 34, 36 are pulled laterally toward the fixed frame 12, thereby relocating the tracks 34, 36 to a new position nearer to the fixed frame 12 so that a new cut can be made in the stone. Alternatively, the hand operated winches may be motor operated winches.

There is a gauging system provided in order to make sure that the tracks 34, 36 are moved a predetermined, accurate distance to carry out that subsequent cut. Accordingly, there are a pair of spacing members 64, 66 removable affixed to the horizontal member 26 and a corresponding pair of spacing member 68, 70 removable affixed to the other horizontal member 28.

The corresponding, or opposite, spacing devices are the same length, that is spacing member 64 is the same length as spacing member 68 whereas spacing member 66 is the same length as spacing member 70. As will be seen, the spacing members may be steel angle irons and may be affixed to the horizontal member 26 by clamps 72, 74 and to the horizontal member 28 by clamps 76, 78, so that the spacing members are easily detached and reattached to the horizontal members 26, 28. The spacing members 64, 66, for example, are positioned end to end and the spacing member 64 is in abutting contact with the frame 12.

There are also locking devices 80, 82 that also may be clamps and which lock the horizontal members 26, 28 to the frame 12 so as to prevent the normal sliding movement allowed between the horizontal members 26, 28 and the frame 12. In the exemplary embodiment, the locking devices 80, 82 can clamp the horizontal members 26, 28 against the side frame members 14, 16 of the fixed frame 12 as will be later further explained.

Finally, with respect to FIG. 1, there can be seen a number of cuts 84 that have been made in the underlying stone illustrating the lateral progress of the cutting machine as it moves to successive locations by the apparatus of the present invention.

Figure 2:
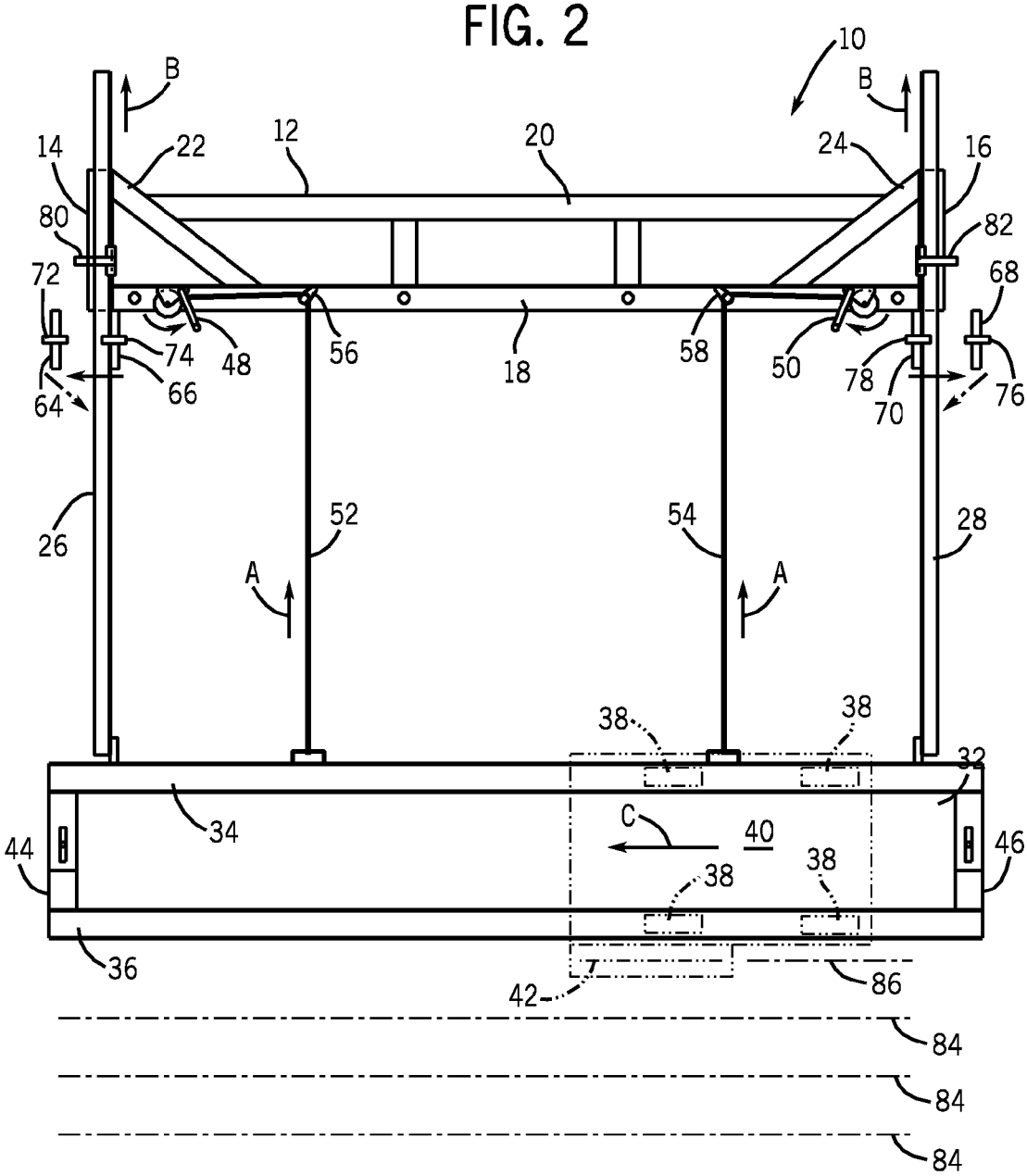
FIG. 2 is a top plan view of the material cutting apparatus constructed in accordance with the present invention illustrating the apparatus in another position.

Turning now to FIG. 2, taken along with FIG. 1, there is shown a top, plan view of the material cutting apparatus 10 of the present invention where the cutting machine 40 has been moved laterally to a new location and is now making the cut 86. In order to carry out that progression of the cutting machine 40, the tracks 34, 36 have been moved laterally a predetermined distance. To that end, the spacing members 64, 68 have been removed, leaving a space between the fixed frame 12 and the next spacing members 66, 70. The locking devices 80, 82 are released so that the horizontal members 26, 28 are free to slide with respect to the fixed frame 12.

Thus the winches 48, 50 can be manually cranked to draw the cables 52, 54 inwardly in the direction of the arrows A to move the tracks 34, 36 toward the frame 12. The movement continues until the spacing members 66, 70 reach and contact the frame 12, at which point, the movement of the tracks 34, 36 must terminate. Thus, the tracks 34, 36 have been moved the distance equal to the length of the spacing members 64, 68 and the outer spacing devices 66, 70 now contact the frame 12, preventing further movement of the tracks. With the tracks 34, 36 now having moved laterally the distance of the length of the spacing devices 64, 68 in the direction of the arrows B, the locking devices 80, 82 are enabled to lock the tracks 34, 36 in that new location. The cutting machine 40 is therefore able to move along the tracks 34, 36 in the direction of the arrow C to make a succeeding cut 86 in the stone.

Figure 3:
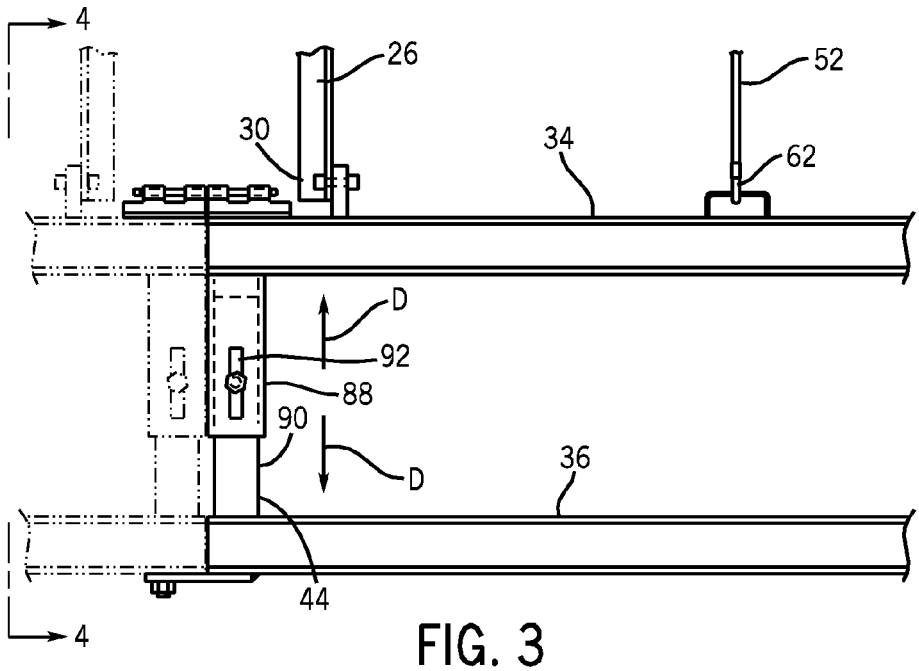
FIG. 3 is a top view of the present invention.
Figure 4:
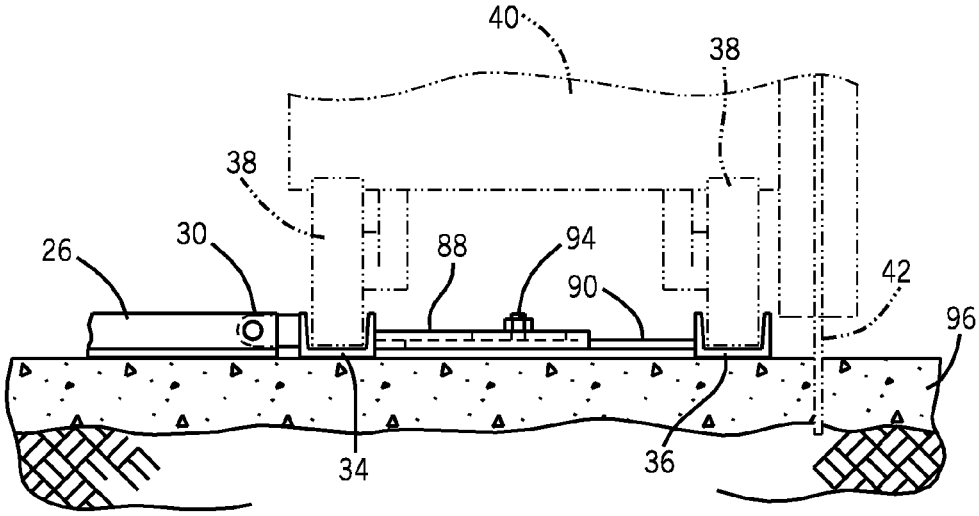
FIG. 4 is a side view of the invention taken along the line 4-4 of FIG. 3.

Turning now to FIGS. 3 and 4, there is shown a top view and side view taken along the line 4-4 of FIG. 3, respectively, of the tracks 34, 36 and illustrating a system employed in the present invention to change the distance between the tracks 34, 36 in order to adjust the tracks 34, 36 to account for the spacing between the wheels 38 for different cutting machines 40. As such, taking, for example, the cross members 44 which functions in the same manner as the cross member 46 (FIGS. 1 and 2), the cross remember 44 is comprised of separate sliding components 88, 90 where one of those components has an elongated slot 92. The components 88, 90 are thus secured together in a sliding relationship and secured by a bolt/nut 94 or other securing means to lock the components 88, 90 together when the proper spacing has been achieved between the tracks 34, 36.

Accordingly, when the bolt/nut 94 is loosened, the components 88, 90 can be moved outwardly with respect to each other in the direction of the arrows D to increase the space between the tracks 34, 36 to accommodate the particular cutting machine. When the proper distance has been achieved, the bolt/nut 94 is simply tightened to again lock that distance separating the tracks 34, 36 such that the cutting machine 40 can move along the tracks 34, 36 with the cutting blade 42 cutting into the stone layer 96.

Figure 5:
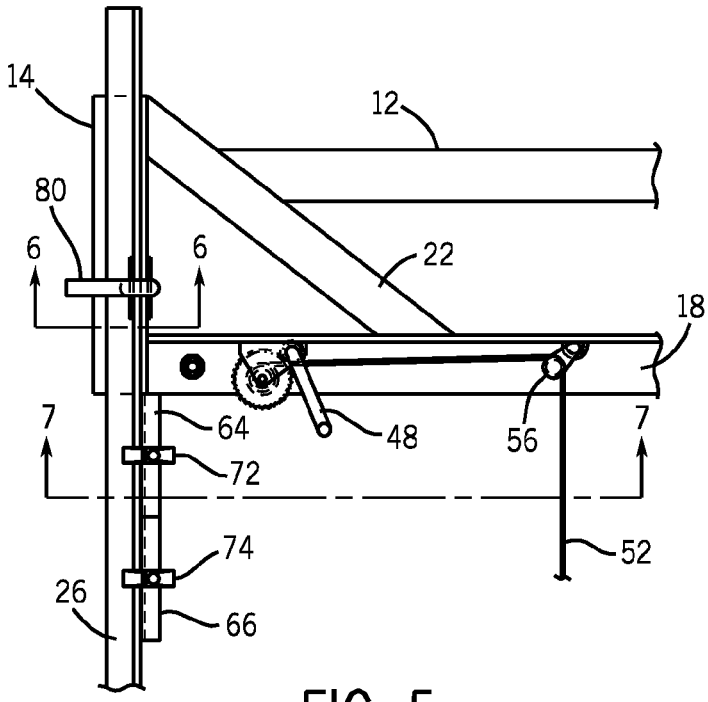
FIG. 5 is an enlarged top view of the present invention and illustrating the function of the present system.

Turning now to FIG. 5 there is shown an enlarged top view of the present invention and illustrating the function thereof. The function is described with respect to the horizontal member 26, it being seen that the same function applies to the horizontal member 28 (FIGS. 1 and 2). As can be seen, both of the spacing members 64, 66 are affixed to the horizontal member 26 in an end to end orientation by clamping devices 72 and 74. Also, the locking device 80 is in place such that the locking device 80 is clamping the horizontal member 26 to the frame side frame member 14 of the fixed frame 12, thereby preventing the normal sliding movement between the horizontal member 26 and the fixed frame 12. The winch 48 is also illustrated and which is affixed to the frame 12 with the cable 52 passing through pulley 56 and extending toward the tracks 34, 36 (FIG. 1).

Again, FIG. 5 illustrates the present system wherein the locking device 80 is unclamped to allow the horizontal member 26 to slide along the side frame member 14 of the fixed frame 12. The spacing member 64 is removed by releasing the clamp 72 and, by manually rotating the winch 48, the tracks 34, 36 (FIGS. 1 and 2) are moved toward the fixed frame 12 until the next succeeding spacing member 66 comes in contact with the cross frame member 20 of the fixed frame 12 whereupon further movement of the tracks 34, 36 is prevented.

As such, the tracks 34, 36 have been moved an accurate distance equal to the length of the spacing member 64. The spacing member 64 may, of course, be sized to the particular length of cut desired to be made in the stone, and, when one spacing member has been removed to make space for the movement of the tracks, that spacing member can immediately be re-clamped to the same horizontal member in an end to end orientation but away from the remaining spacing member such that the spacing members are leapfrogged to each other.

Figure 6:
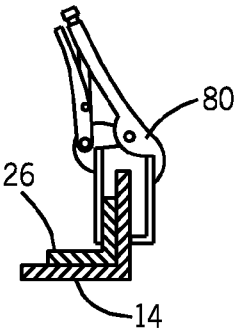
FIG. 6 is a side cross sectional view taken along the line 6-6 of FIG. 5.

Turning to FIG. 6, there is shown a side cross sectional view taken along the line 6-6 of FIG. 5 and illustrating the locking device 80 of the present invention. As can be seen, the locking device 80 holds together the L-shaped horizontal member 26 to the L-shaped side frame member 14 to prevent movement therebetween. Thus, the locking device 80 can lock and unlock the relative movement between the horizontal member 26 and the side frame member 14 of the fixed frame 12 (FIG. 5). While a clamp is illustrated for the locking member, it can be see that other locking devices could be used to lock the horizontal member 26 firmly to the fixed frame 12.

Figure 7:
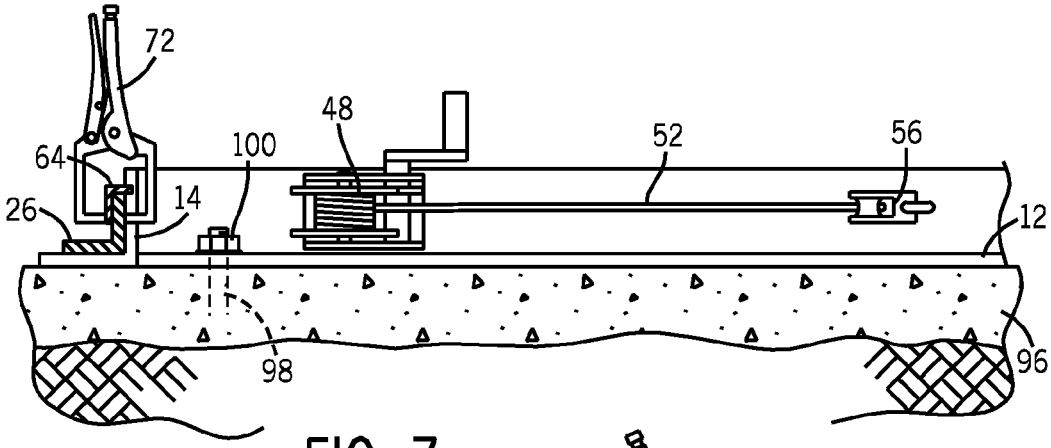
FIG. 7 is a side view of the present invention taken along the line 7-7 of FIG. 5.

Turning, finally, to FIG. 7, there is shown a side view of the present invention taken along the line 7-7 of FIG. 5. In FIG. 7, there can be seen that the L-shaped horizontal member 26 has clamped thereto, a spacing member 64 by means of a clamp 72 The spacing member 64 is shown to be an L-shaped steel angle iron that is, as has been discussed, of a predetermined length that provides a gauge that determines the distance or extent of the movement of the tracks 34, 36 as those tracks 34, 36 are moved by the winch 48. There can also be seen in FIG. 7, a threaded shaft 98 that is embedded into the stone layer 96 and having a nut 100 which solidly affixes the fixed frame 12 to the stone layer 96.

Therefore, according to one embodiment of the present invention, a material cutting apparatus for cutting predetermined widths of a material includes at least one track and a cutting machine adapted to move along the at least one track. The cutting machine includes a cutting blade adapted to cut material as the cutting machine progresses along the at least one track. The apparatus also includes a track adjustment system adapted to move the at least one track a predetermined distance in a generally lateral direction to a new location to cut the material at a predetermined width.

In accordance with another embodiment of the present invention, a track adjustment system for adjusting the location of a material cutting machine having wheels includes a pair of parallel, spaced apart tracks adapted to receive the wheels of a material cutting machine. The track adjustment system is adapted to move the tracks a predetermined distance in a generally lateral direction to a new location. The track adjustment system includes a fixed frame and at least one horizontal member slidingly affixed to the fixed frame, the at least one horizontal member having a distal end affixed to the spaced apart tracks, and a motive device adapted to move the tracks from a first location to a second location a predetermined distance from the first location.

In accordance with yet another embodiment of the present invention, a method of relocating tracks designed to support a material cutting machine having wheels includes positioning a frame in a fixed location on the ground, providing a pair of generally parallel tracks spaced apart to support the wheels of the material cutting machine at a first location, and moving a material cutting machine along the tracks to make a cut in the material. The method also includes providing at least one horizontal member slidably affixed to the frame and having a distal end affixed to the tracks, providing a motive system affixed to the frame and to the tracks adapted to move the tracks relative to the frame, and moving the tracks with respect to the frame to relocate the tracks from the first location to a second location a predetermined distance from the first location.

Those skilled in the art will readily recognize numerous adaptations and modifications which can be made to the stone cutting system of the present invention which will result in an improved system and method of using the same, yet all of which will fall within the scope and spirit of the present invention as defined in the following claims. Accordingly, the invention is to be limited only by the following claims and their equivalents.

What is claimed is:

1. A track adjustment system for adjusting the location of a material cutting machine having wheels, the system comprising a pair of parallel, spaced apart tracks adapted to receive the wheels of a material cutting machine, the track adjustment system adapted to move the tracks a predetermined distance in a generally lateral direction to a new location, the track adjustment system comprising a fixed frame and at least one horizontal member slidingly affixed to the fixed frame, the at least one horizontal member having a distal end affixed to the spaced apart tracks, and a motive device adapted to move the tracks from a first location to a second location a predetermined distance from the first location, wherein the motive device comprises a hand operated winch mounted to the fixed frame and having a flexible cable connected to the tracks.

2. The system of claim 1 wherein the at least one horizontal member comprises a pair of spaced apart, generally parallel, horizontal members.

3. The system of claim 1 further including an adjustment system to change the spacing between the parallel, spaced apart, tracks.

4. The system of claim 1 wherein the system includes a locking device to lock the at least one horizontal member to the fixed frame.

5. The system of claim 1 wherein the system includes at least two spacing devices removably affixed to each of the horizontal members in an end to end relationship, a first of such spacing members being in an abutting contact with the fixed frame and the second spacing member located outwardly therefrom, wherein the first spacing member is removable wherein the motive system can move the tracks to a position wherein the second spacing member is in an abutting contact with the fixed frame, thereby moving the tracks a predetermined distance equal to the length of the first spacing member.

6. A track adjustment system for adjusting the location of a material cutting machine having wheels, the system comprising a pair of parallel, spaced apart tracks adapted to receive the wheels of a material cutting machine, the track adjustment system adapted to move the tracks a predetermined distance in a generally lateral direction to a new location, the track adjustment system comprising a fixed frame and at least one horizontal member slidingly affixed to the fixed frame, the at least one horizontal member having a distal end affixed to the spaced apart tracks, and a motive device adapted to move the tracks from a first location to a second location a predetermined distance from the first location, and an adjustment system to change the spacing between the parallel, spaced apart, tracks.

7. The system of claim 6 wherein the at least one horizontal member comprises a pair of spaced apart, generally parallel, horizontal members.

8. The system of claim 6 wherein the motive device comprises a hand operated winch mounted to the fixed frame and having a flexible cable connected to the tracks.

9. The system of claim 6 wherein the system includes a locking device to lock the at least one horizontal member to the fixed frame.

10. The system of claim 6 wherein the system includes at least two spacing devices removably affixed to each of the horizontal members in an end to end relationship, a first of such spacing members being in an abutting contact with the fixed frame and the second spacing member located outwardly therefrom, wherein the first spacing member is removable wherein the motive system can move the tracks to a position wherein the second spacing member is in an abutting contact with the fixed frame, thereby moving the tracks a predetermined distance equal to the length of the first spacing member.

11. A track adjustment system for adjusting the location of a material cutting machine having wheels, the system comprising a pair of parallel, spaced apart tracks adapted to receive the wheels of a material cutting machine, the track adjustment system adapted to move the tracks a predetermined distance in a generally lateral direction to a new location, the track adjustment system comprising a fixed frame and at least one horizontal member slidingly affixed to the fixed frame, the at least one horizontal member having a distal end affixed to the spaced apart tracks, and a motive device adapted to move the tracks from a first location to a second location a predetermined distance from the first location, wherein the system includes at least two spacing devices removably affixed to each of the horizontal members in an end to end relationship, a first of such spacing members being in an abutting contact with the fixed frame and the second spacing member located outwardly therefrom, wherein the first spacing member is removable wherein the motive system can move the tracks to a position wherein the second spacing member is in an abutting contact with the fixed frame, thereby moving the tracks a predetermined distance equal to the length of the first spacing member.

12. The system of claim 11 wherein the at least one horizontal member comprises a pair of spaced apart, generally parallel, horizontal members.

13. The system of claim 11 wherein the motive device comprises a hand operated winch mounted to the fixed frame and having a flexible cable connected to the tracks.

14. The system of claim 11 further including an adjustment system to change the spacing between the parallel, spaced apart, tracks.

15. The system of claim 11 wherein the system includes a locking device to lock the at least one horizontal member to the fixed frame.

* * * * *

UNITED STATES PATENT AND TRADEMARK OFFICE

CERTIFICATE OF CORRECTION

PATENT NO. : 7,658,187 B2
APPLICATION NO. : 11/623732
DATED : February 9, 2010
INVENTOR(S) : Budiac et al.

It is certified that error appears in the above-identified patent and that said Letters Patent is hereby corrected as shown below:

Col. 5, line 16, delete "remember" and
substitute therefore -- member --.

Col. 6, line 16, delete "72" and
substitute therefore -- 72. --.

Signed and Sealed this

Twenty-seventh Day of April, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,658,187 B2
APPLICATION NO. : 11/623732
DATED : February 9, 2010
INVENTOR(S) : Budiac et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 299 days.

Signed and Sealed this

Thirtieth Day of November, 2010

David J. Kappos

David J. Kappos
*Director of the United States Patent and Trademark Office*